United States Patent [19]

Speckin

[11] 3,975,068

[45] Aug. 17, 1976

[54] COLUMN MOUNTED TOOL HOLDER

[76] Inventor: Leonard A. Speckin, 308 Academy, Portland, Mich. 48875

[22] Filed: Sept. 23, 1974

[21] Appl. No.: 508,082

Related U.S. Application Data

[63] Continuation-in-part of Ser. No. 426,545, Dec. 20, 1973, Pat. No. 3,920,295.

[52] U.S. Cl. ..... 312/254; 108/114; 108/151; 211/107; 248/221 F; 248/226 D; 248/230; 312/330 R

[51] Int. Cl.[2] ..... A47B 9/08

[58] Field of Search ..... 108/151, 154, 114, 149, 108/50, 110, 111, 107, 64; 248/125, 221, 226 D, 68 CB, 67.5, 230; 211/107; 312/254, 330

[56] References Cited

UNITED STATES PATENTS

| | | | |
|---|---|---|---|
| 1,350,367 | 8/1920 | Giddings | 211/107 |
| 2,674,772 | 4/1954 | Jacobs | 248/68 CB |
| 2,721,334 | 10/1955 | Sanders | 248/230 X |
| 3,000,512 | 9/1961 | Maynor | 108/151 |
| 3,495,795 | 2/1970 | Brown | 248/221 |
| 3,588,152 | 6/1971 | Shomo | 403/344 |

FOREIGN PATENTS OR APPLICATIONS

| | | | |
|---|---|---|---|
| 702,176 | 1/1941 | Germany | 248/68 CB |
| 10,194 | 7/1897 | United Kingdom | 248/230 |
| 538,730 | 8/1941 | United Kingdom | 248/68 CB |

*Primary Examiner*—Roy D. Frazier
*Assistant Examiner*—William E. Lyddane
*Attorney, Agent, or Firm*—D. Edward Dolgorukov

[57] ABSTRACT

An improved column mounted tool holder for mounting on typical basement or factory support columns of varying sizes. The tool holder includes a pair of complementay structural members that are bolted to each other about a support column to define a work surface on all sides of the column, and each structural member mounts an associated clamp member with a V-shaped clamping surface for adjusting movement to allow the clamping of different size columns. The structural members preferably are of elongated configurations with U-shaped cross sections that open sideways toward each other so as to provide upper and lower walls between which the clamp members are slidably mounted. This configuration of the structural members allows drawers to be received by the ends of the structural members to hold small parts. Pin and slot arrangements guide the clamp members during adjusting movement thereof, and this movement is provided by rotation of a pair of bolts that extend between each clamp member and a threaded aperture in the vertical wall of the associated structural member.

9 Claims, 17 Drawing Figures

COLUMN MOUNTED TOOL HOLDER

This application is a continuation-in-part of my prior copending application Ser. No. 426,545, filed Dec. 20, 1973, now U.S. Pat. No. 3,920,295, and relates to a column mounted tool holder for mounting of power or hand operated tools or similar devices in areas where floor space is at a premium, such as in the typical home workshop or factory environment. The mounting of these tools in useful working positions is accomplished without the use of any additional floor space by making use of the typical basement stanchion pipe or support column.

Applicant having had for several years a home workshop of his own, and being all too familiar with the space problems present in such home workshops, has long sought ways to more efficiently utilize the limited amount of space available. It is conventional practice in such home workshops to mount small power tools or hand operated tools upon a freestanding work bench which takes up considerable amounts of floor space. In addition, the tools take up valuable work area on the top of said work bench, which is also at a premium.

In Applicant's search for a better way to mount small power tools and the like, Applicant at first attempted to obtain conventional pedestal stands, such as are used in factories for the mounting of grinders and the like, at a reasonable price which the home workshop enthusiast could afford. Applicant was thwarted in his attempt due to the relatively expensive nature and scarcity of supplies of such pedestal stands, putting the expense of mounting the typical tools found in the home workshop beyond the means of most people similarly situated. In addition, it is common that such a pedestal will only hold one type of power tool, making the purchase of a number of pedestal stands necessary at relatively expensive prices.

Finding the relatively great expense and limited use of conventional pedestal stands not satisfactory, Applicant kept looking for different methods of clearing the typical home workbench of power tools so that it could be used for its intended purpose. Having several vertical support pipes in his home workshop, Applicant next sought a way to provide a table supported by the support column, whereby several hand or power operated tools could be approached from all sides, and the expense of conventional mounting means could be greatly reduced.

Applicant is familiar with one device which has attempted to solve the above mentioned problems. Such device is disclosed in the patent to R. H. Brown entitled "Vice Holder", bearing Patent No. 3,495,795. However, even this device leaves several problems unsolved in the search to find a satisfactory column mounted tool holder. First of all, this device can only be used to mount a vice due to its specific construction, and does not allow mounting of any other tools. In addition, it is a relatively expensive device possibly costing more than the previously mentioned pedestal stands and, therefore, out of the reach of many home workshop enthusiasts.

In addition, since the Brown device appears to be only an adaptation of the idea on which a drill press table is based, it can only be used on one size pipe, which could have only a very limited variation in size. This condition is just not found in home or factory stanchion pipes which can vary, plus or minus 0.050 inches in diameter, and come in different sizes. For instance, if the Brown device was made to fit a 4 inch diameter pipe, if the pipe had a diameter of 3.95 inches, it is quite possible that when tightening the device up to get a firm grip on the column, due to the fact that it is probably made of cast iron, the device itself may crack, rendering it completely useless.

Also, I have found that many homes have a 3 inch or 3½ inch diameter support column, rather than the typical 4 inch diameter column. The device of Brown is made only for a column of one diameter and cannot be used with a column of another diameter if the owner of such device should move; however, I have made my tool holder useable on all of the above diameter columns. In addition, even when the diameter of the pipe can vary plus or minus seventy-thousandths of an inch or more, my tool holder can still firmly clamp onto the support column.

Accordingly, an object of the present invention is to provide an improved column mounted tool holder to utilize the heretofore wasted floor space occupied by the typical stanchion pipe in the home workshop or elsewhere.

Another object of the present invention is to provide this improved column mounted tool holder for use in the home workshop to eliminate the problem of the scarcity of supply of conventional pedestal stands for power tools at reasonable prices.

A further object of the present invention is to provide the improved column mounted tool holder with sufficient space to mount several different size items.

A further object of the present invention is to provide the improved column mounted tool holder with sufficient rigidity to firmly hold relatively heavy hand and power operated tools such as may be found in the typical home workshop.

A still further object of the present invention is to provide the improved column mounted tool holder so as to be adaptable to fit the large variation in sizes of the typical basement stanchion pipe or column.

A still further object of the present invention is to provide the improved column mounted tool holder with storage drawers for holding small parts and the like.

A still further object of the invention is to provide a column mounted tool holder which is relatively simple and inexpensive to manufacture.

A still further object of the present invention is to provide a column mounted tool holder which is easily manufactured in a wide variety of sizes and shapes.

In carrying out these and other objects of the invention, an adjustable embodiment of the tool holder utilizes a plurality of structural members which are adapted to be secured to each other about a vertical support column, preferably by nut and bolt arrangement, so as to integrate the structural members into a unitary tool holder. Clamp members of this adjustable embodiment are mounted on the structural members so as to be horizontally spaced about the column on which the tool holder is to be mounted and the clamp members have V-shaped clamping surfaces facing the column. At least one of the clamp members is movable toward and away from the column to permit the clamp members to clamp columns of different sizes and thereby mount the tool holder.

Preferably, the adjustable embodiment utilizes two structural members and two clamp members respectively associated therewith, with the structural members having elongated configurations defining U-shaped cross sections opening sideways toward each other, and with the clamp members slidably mounted between upper and lower walls of the structural members in a 180° opposed relationship on opposite sides of the column on which the tool holder is to be mounted. A pair of screws respectively extend between the vertical wall of each structural member and the associated clamp member so that screw rotation in one direction moves the clamp members toward each other to clamp smaller columns and rotation in the other direction permits clamping of larger columns. Pin and slot arrangements between the clamp members and the upper or lower walls of the structural members guide the clamp members as they are adjustably positioned by the screws. The U-shaped cross sections of the structural members, in addition to providing a ready manner of mounting the clamp members, permits drawers to be slidably received by the ends of the structural members so as to hold small parts.

For best results, the clamp members of the preferred adjustable embodiment have tubular configurations of a rectangular nature and V-shaped notches therein define the V-shaped clamping surfaces for engaging columns on which the tool holder is mounted. These V-shaped clamping surfaces are provided with serrations so as to provide a secure grip on the column. Also, disc shaped members receive ball shaped portions on the ends of the screws and engage the clamp members to hold them in position clamping onto the column.

Further objects and advantages of this invention will be apparent from the following description and appended claims, reference being made to the accompanying drawings forming a part of this specification, wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways within the scope of the claims. Also it is to be understood that the phraseology and terminology employed herein is for the purpose of description, and not of limitation.

Figure 2:
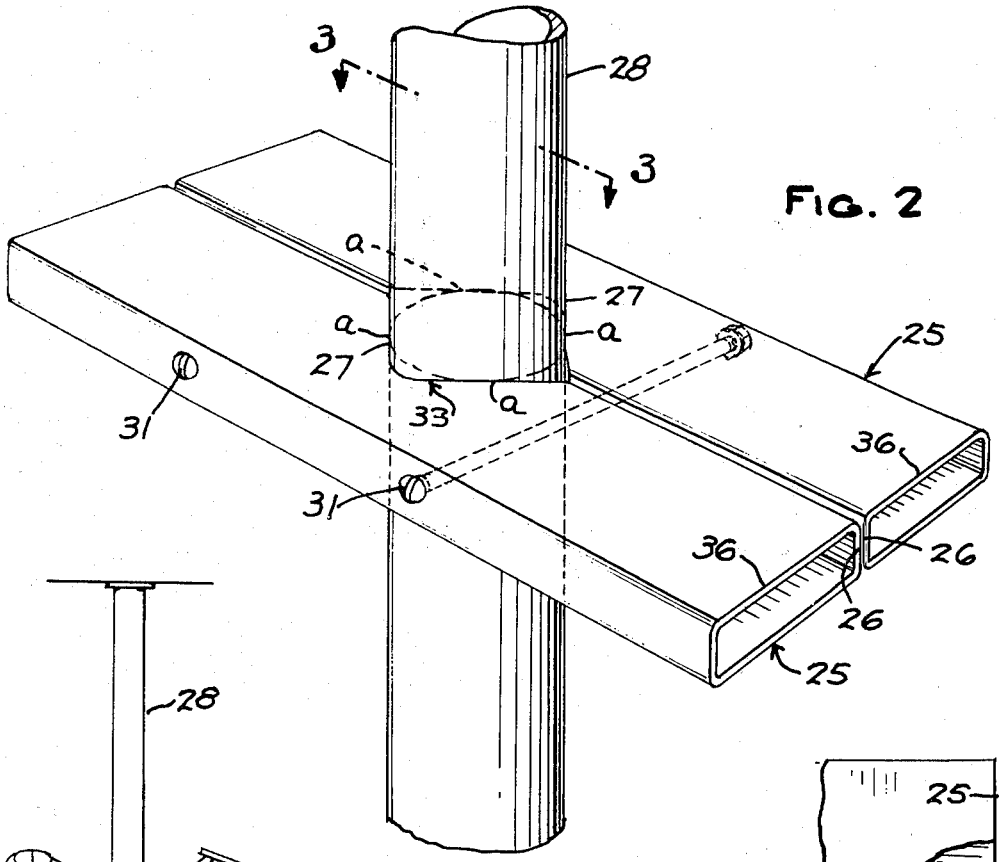
FIG. 2 is a perspective view of the present invention mounted on a support column.
Figure 1:
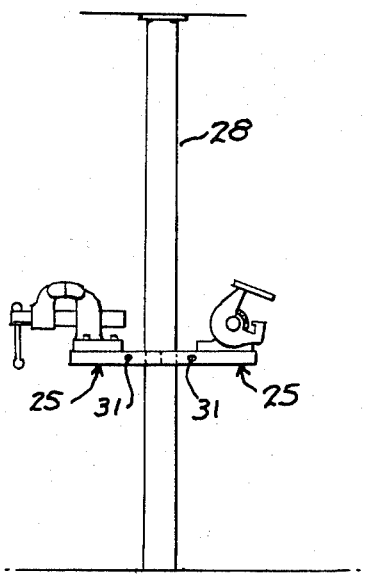
FIG. 1 is a side elevational view showing the tool holder of the present invention mounted on a support column, and having a vice and bench grinder mounted thereon.
Figure 3:
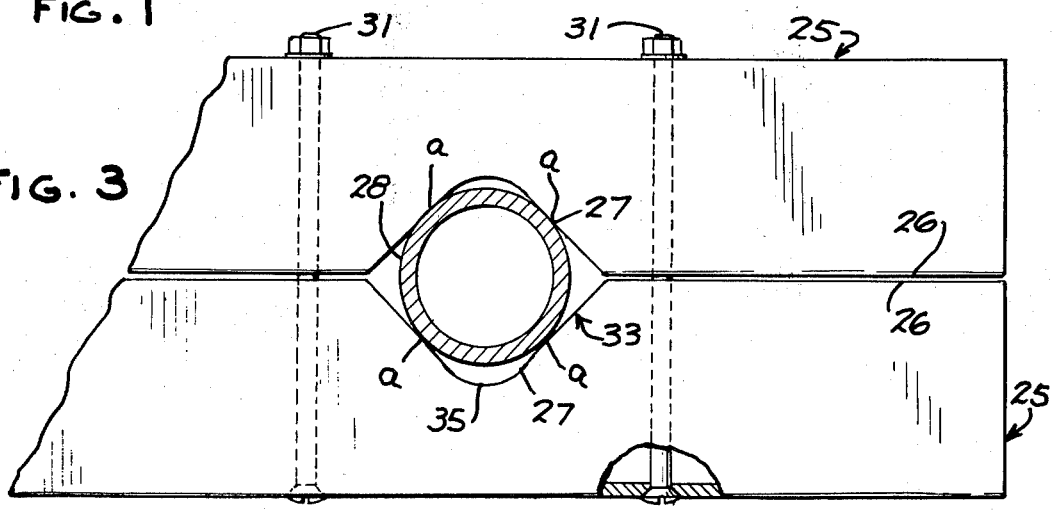
FIG. 3 is a sectional view taken in the direction of the arrows on the section line 3—3 of FIG. 2.

In accordance with my invention, referring to FIGS. 1–3, I provide at least two structural members, in this case made of rectangular seamless tube, and generally designated by the number 25, each of which has at least one side complementary in shape to one side of the other structural member so that they will fit together when assembled to form a substantially unitary construction, when fastened with appropriate means. The matching or complementary side on each of the two frame members is designated by the numeral 26. In each of the complementary shaped sides 26 is provided a V-groove 27 of substantially the same size and shape, said V-groove also being in substantially the same position in each of said edges. The dimension of the V-grooves 27 are selected so that when the two structural frame members 25 are bolted together in contiguous positions by means of the bolt and nut assemblies 31, the diamond shape opening formed by the V-grooves 27, and generally designated by the numeral 33, will have its longest dimension slightly smaller than the outside diameter of the support column 28, so that the support column will be engaged at points around its periphery as shown in FIG. 3 with the letter *a*.

It should be understood that while the two structural members 25 are shown here made of seamless rectangular tubing and are rectangular in shape the members 25 could be of any suitable shape so long as the sides of the frame members, such as 26, were complementary in shape and the V-grooves 27 were placed in positions in each of said members 26 such that the support column 28 would be engaged at the points as was previously described. For instance, square or semi-circular frame members may be used. Also, more than two structural members may be used if the need should arise, as long as the shapes of each of the members where such that, when assembled in contiguous positions, a substantially flat and continuous work area were formed by the top surfaces of said structural members. I feel that this feature of my design allows my column mounted tool holder to be made in practically any size and shape depending on the particular job that must be done in the work-shop, and the number of tools to be mounted thereon. For instance, by making the frame members 25 of greater width, tools may be mounted around the entire periphery of the support column 28, while if this is not practical, making the frame members of greater length than shown in FIG. 2 could result in the mounting of several tools side by side on each side of the column 28, depending on the space available. All this is accomplished without the use of valuable floor space in the workshop and without significantly increasing the production cost of the tool holder. It should also be understood that by virtue of using V-grooves 27 to engage the post 28, a great variety of sizes and shapes of columns can be utilized by my invention. This is in complete contrast to the previous design of column supported tables, which were designed for, and had to be used on only one size support column, or which could not be assembled around the support pipe, but had to be mounted over the top of the pipe, which made them unusable for the purposes of the present invention.

For instance, referring to FIG. 3, merely lengthening the bolts 31 will permit my device to fit on a larger column than the one shown therein. While I normally make the size of the V-grooves so that the standard 4 inch diameter column will cause the two members 25 of my tool holder to be slightly separated, so that upon tightening the bolts 31, the column 28 will be firmly engaged within a range of approximately 0.070 inch of column diameter, I have also provided for the situation where a smaller column may be encountered.

Figure 13:
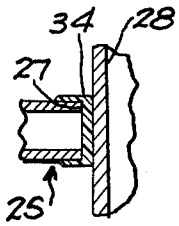
FIG. 13 is a partial sectional view taken in the direction of the arrows on the section line 13—13 of FIG. 12.

Referring to FIG. 13, by means of the spacers 34 which fit over the edges of the V-grooves 27, I can provide for my invention to fit 3 inches, 3½ inches, or other diameter columns, within practical limits. Again, if the spacers 34 are provided, they are designed so that the dimension of the opening 33 formed in the frame members is smaller than the column by approximately 0.070 inch, so that if variation is found in the size of the support column, this will be compensated for.

It should be understood that by virtue of the V-groove construction, I have solved the previous problem present in the art of what to do when the diameter of the column is found to vary from its normal dimensions. If the column is larger than anticipated, the two sides 26 of the members 25 are forced to be spaced a slightly greater than normal distance apart, while if the column is slightly smaller than its nominal dimension, the provision of making the V-grooves of a size such that the opening is smaller than the column, provides that a smaller than anticipated support column will still be gripped firmly, with the edges 26 of the structural members 25 merely coming closer together.

Another advantange of my design is immediately apparent in the situation where a substantially square-shaped support column is found, such as when an I-beam is used as a support column. In this instance, instead of providing a curved portion 35 on the inner edges of the V-groove 27, I provide that this portion be a right angle. It can then be seen that when the two halves 25 of the tool holder are bolted together, an I-beam will be gripped firmly by the V-grooves 27, again firmly supporting the tool holder.

Figure 5:
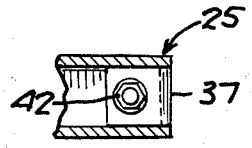
FIG. 5 is a sectional view taken in the direction of the arrows on the section line 5—5 of FIG. 4.
Figure 4:
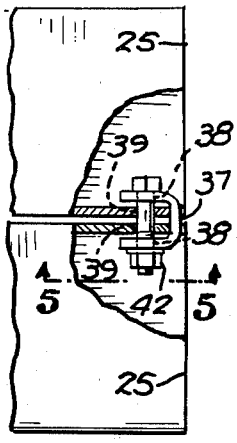
FIG. 4 is a plan view of the present invention, partially cut away, showing a different method of fastening the two halves of the tool holder together.

In an application where the two structural members 25 must be of greater length to form a longer work surface on the top surfaces of the structural members 25, or in applications where it is not possible to put the bolt and nut assemblies 31 entirely through the structural members 25 due to the width thereof, or for other reasons, fastening means such as those shown in FIGS. 4 and 5 may be used.

In this embodiment, holes 39 are provided in identical positions near the end of the members 25 in the side 26 thereof. A C-shaped member 37 with holes 38 provided so as to align themselves with the holes 39 is provided, through which a shorter bolt and nut assembly 42 is passed and tightened down. In this way fastening means to provide rigidity for the column mounted tool holder are provided.

Figure 6:
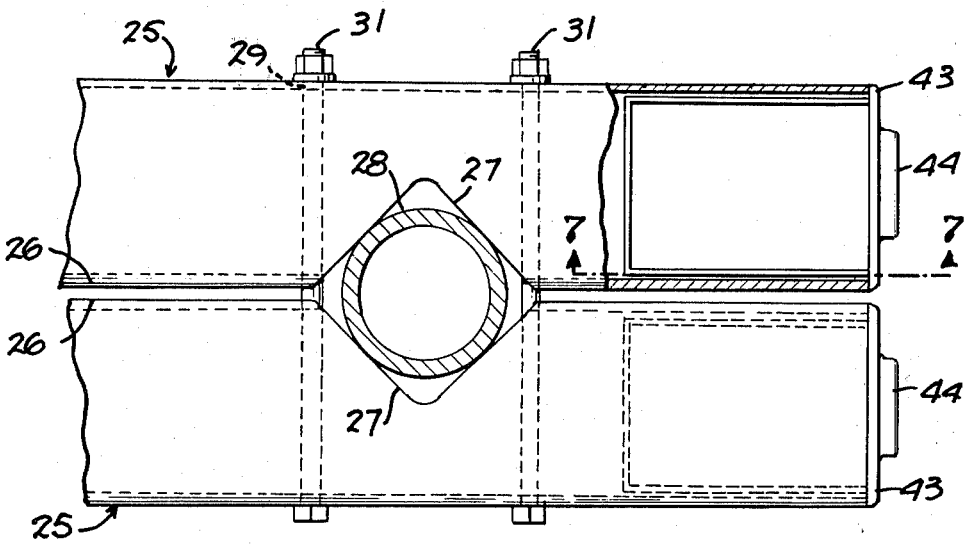
FIG. 6 is a plan view of the present invention, partially cut away, showing parts drawers installed in the ends of the structural members forming parts of the present invention.
Figure 7:
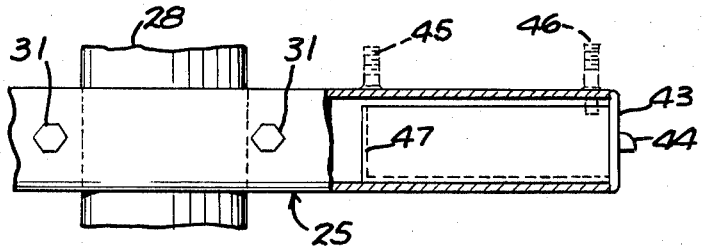
FIG. 7 is a partially cut-away sectional view taken in the direction of the arrows on the section line 7—7 of FIG. 6.

Referring specifically to FIGS. 6 and 7, I have provided small drawers 43 of suitable size to fit in to the opening at each end of the member 25. Such drawers may be of any length desired and are only limited by the position of the bolt and nut assemblies 31. The width of the drawers is preferably substantially the same as the width of the opening in the end of the member 25, while the height of the drawer is substantially the height of said opening. In this way I have provided storage space for the small parts normally used in connection with the devices which are intended to be mounted on my improved column mounted tool holder. Such storage space not previously being available, and causing much added work and aggravation to the person attempting to use a tool mounted on a support column, as he must constantly make trips back and forth to the work bench to obtain needed parts. Handles 44 may be provided on the drawers 43 for ease in opening and closing said drawers.

While I generally prefer not to provide any special holes or other means for mounting the tools thereon, but prefer to let the user of my column-mounted tool holder drill holes in the top surface 36 of the structural members 25 in accordance with his particular needs, and the devices he desires to mount, in certain cases, as in FIG. 7, it may be desirable to provide tool mounting studs 45 as an integral part of my device. These studs may be welded on as shown, or threads may be provided so that these studs may be screwed into the top surface of the frame member. In certain instances it may be desirable that one of the studs, such as member 46, protrude slightly into the area occupied by the drawer 43, so as to provide a positive stop for said drawer when the back portion 47, of the drawer 43, contacts the bottom of the stud 46, thereby preventing the drawer from being pulled completely out.

Figure 8:
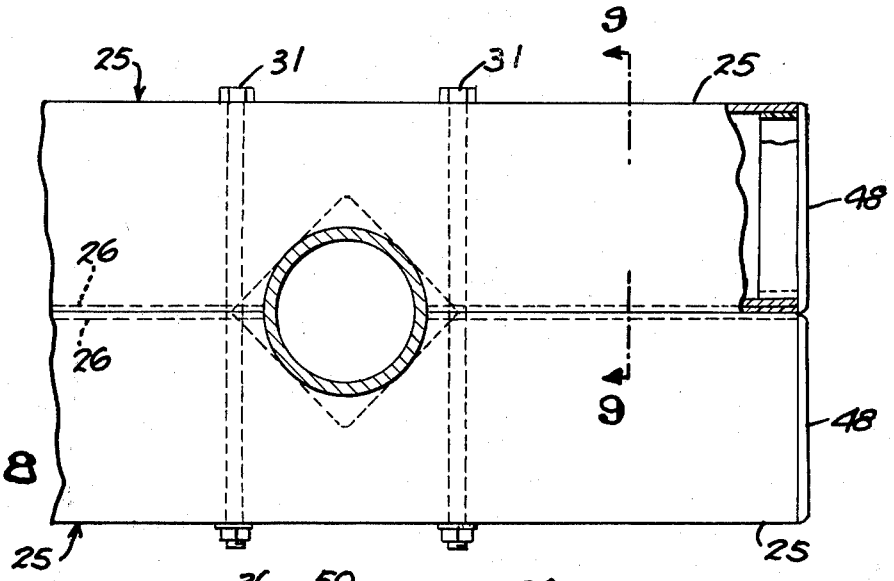
FIG. 8 is a plan view of the present invention, partially cut away, showing means for closing the otherwise open ends of the present invention, and showing the installation of a cover on the top surface of the invention for the purpose of providing a completely flat and noise-dampening work surface.
Figure 9:
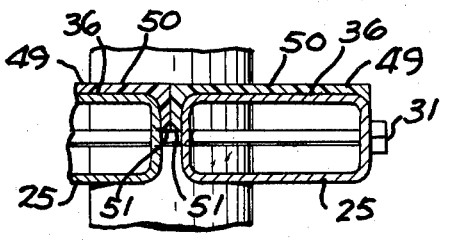
FIG. 9 is a sectional view taken in the direction of the arrows on the section line 9—9 of FIG. 8.

Referring to FIGS. 8 and 9, when it is not desired to have drawers in the ends of the members 25, for safety purposes, the ends of the structural members 25 may be closed by plastic end caps 48.

I have also found it desirable in some instances to close the gap existing by virtue of the two sides 26 of the members 25 being spaced apart some small distance as previously described. I have found that in some instances, small tools or objects common in the home workshop may fall through such opening and be easily lost or stepped upon. For this reason I have provided the closures 49, shown best in FIG. 9. These closures are substantially L-shaped, and may be made of any suitable material. I prefer that these be molded of soft plastic for ease of manufacture. It can be seen that the longer portions 50 of the closures 49, when properly mounted, form a continuous flat work surface, while the shorter portions 51 fill in the gap left by the opening between the sides 26 of the members 25.

The closures 49 may be very useful for different purposes, depending upon the material they are made of. The closures may be very useful in damping the vibration present in many motor driven power tools, therefore, eliminating the problem of the vibrations set up in the members 25, by virtue of the operation of the electric tools or other devices, from causing small parts or other objects to vibrate and fall off the work surface 36. A maximum damping of the vibration can be expected when the closures 49 are molded from a softer type material, such as a soft plastic or rubber. It should be understood that the closure can also be made of one piece construction, rather than the two piece construction shown in FIG. 9.

Figure 10:
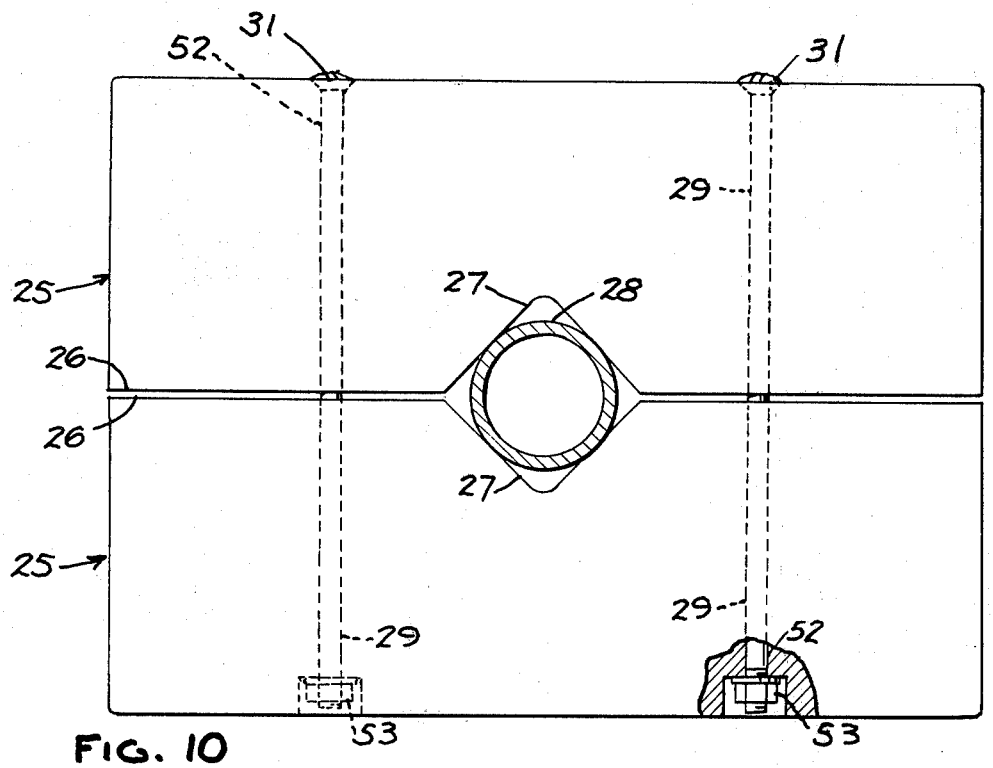
FIG. 10 is a plan view showing a modification of the present invention wherein the two structural members forming a part of the invention are of solid metal construction to provide the necessary rigidity for extra heavy power tools and machines, etc.
Figure 11:
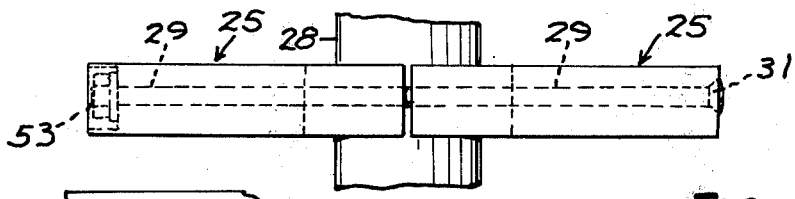
FIG. 11 is a side elevational view of the modification shown in FIG. 10.

Referring to FIGS. 10 and 11, there is shown an example of how the structural members of my invention can be made of a solid construction, rather than the hollow tubular construction previously shown. In this illustration, the members 25 are shown of a solid metal construction, such as cast or plate aluminum or other metal. The details of construction of this embodiment of the invention are substantially similar to that just disclosed for the tubular construction, with the exception that in this instance, the bolt and nut assemblies 31, instead of passing through holes 29 drilled in relatively thin metal, must pass through holes 52 drilled through solid metal. In order that the bolt and nut assembly 31 will not dangerously protrude from the edge of the solid metal piece, counter-sunk recesses 53 are provided to enclose the end of the bolt and nut assembly. Such recesses either may be cast in, if the material used is suitable for casting purposes, or milled in, if plate material is used.

Figure 12:
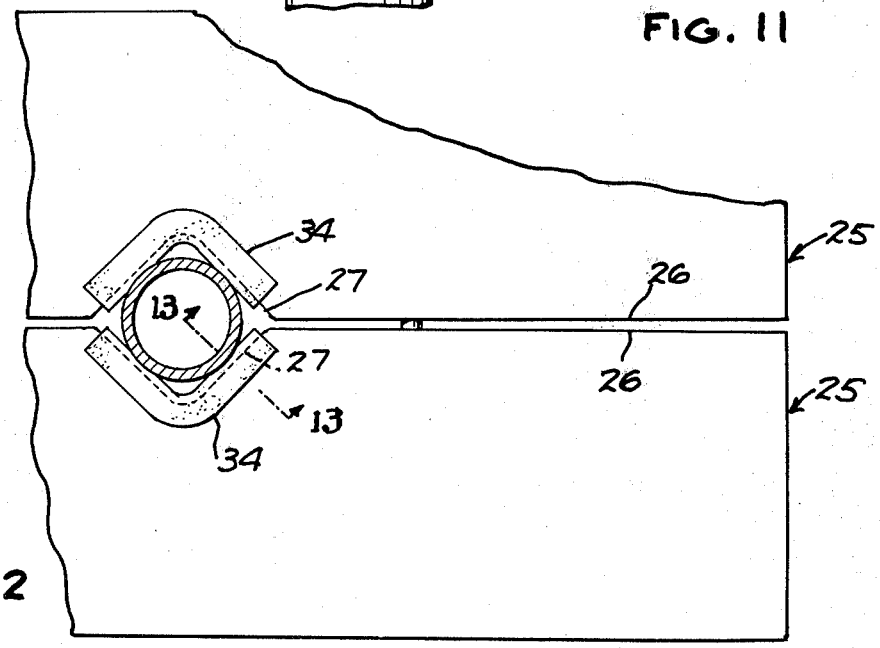
FIG. 12 is a cut away plan view of the present invention with spacers installed in the V-grooves thereof to adapt said invention for installation on smaller than normal size support posts.

Now referring to FIGS. 12 and 13, as previously mentioned, spacers 34 may be inserted into the V-grooves 27 to provide for the situation where a smaller than normal size basement support column is encountered. Such spacers may either be used on the hollow tubular structural members, as shown in FIG. 13, or on solid members as shown in FIGS. 10 and 11.

Figure 14:
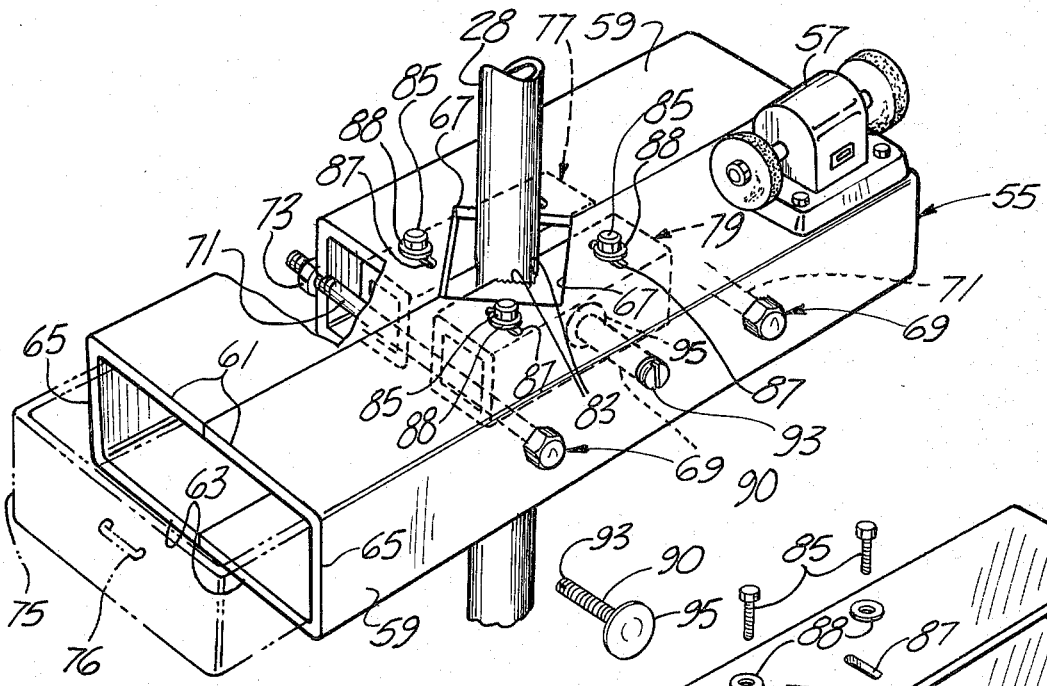
FIG. 14 is a perspective view of an adjustable embodiment of the tool holder, according to the invention, wherein a pair of clamp members are adjustably positioned on structural members bolted about a column on which the tool holder is adapted to be mounted, with the adjustment permitting mounting of the tool holder on columns of varying sizes.

FIGS. 14 through 17 show an adjustable embodiment of my tool holder which is generally indicated by numeral 55. As seen in FIG. 14, this tool holder 55 may be used to support an electric motor grinder 57 or any other shop tool of the type ordinarily used in the typical home workshop. The illustrated adjustable embodiment includes a pair of complementary structural members 59 which have elongated configurations. These structural members have generally U-shaped cross sections that define spaced upper and lower walls 61 and 63, respectively, as well as vertical walls 65 which extend between the upper and lower walls. The structural members 59 open sideways toward each other on opposite sides of a round support column 28 like those found in the typical factory or home basement. Generally V-shaped notches 67 in the upper and lower walls of the structural members 59 receive the column 28 when the tool holder is in its mounted condition. Nut and bolt arrangements 69 are positioned on each side of column 28 and include bolts 71 and nuts 73. These nut and bolt arrangements extend between the vertical walls 65 of the structural members 59 to hold these members together in a unitary manner. The upper walls 61 of the structural members thus provide a surface for mounting tools such as grinder 57, and the ends of the structural members open outward in generally rectangular configurations so as to be capable of slidably receiving drawers such as drawer 75 shown in FIG. 14 by phantom lines. This drawer may be used to hold small parts such as the kind used in a workshop, and has a handle 76 to facilitate opening the drawer.

Figure 15:
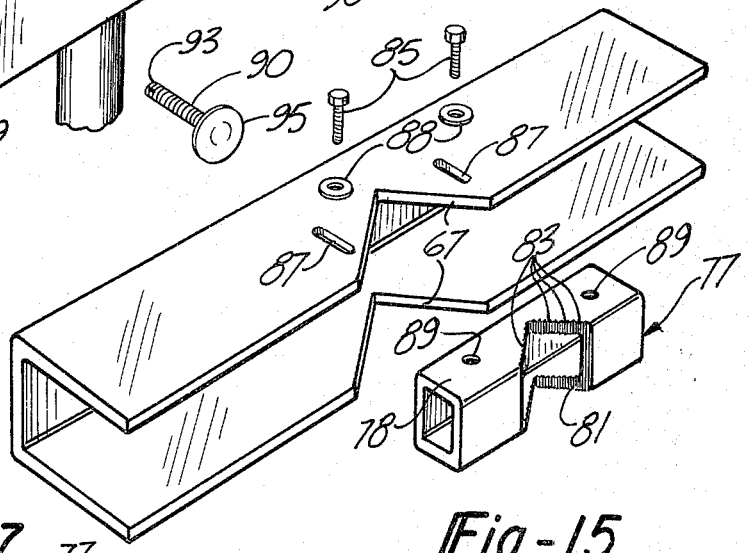
FIG. 15 is an exploded perspective view of one of the structural members and one of the clamp members, and shows pin and slot arrangements that guide the clamp member as well as a screw which is rotated to apply clamping pressure to the clamp member via a disc shaped member.
Figure 16:
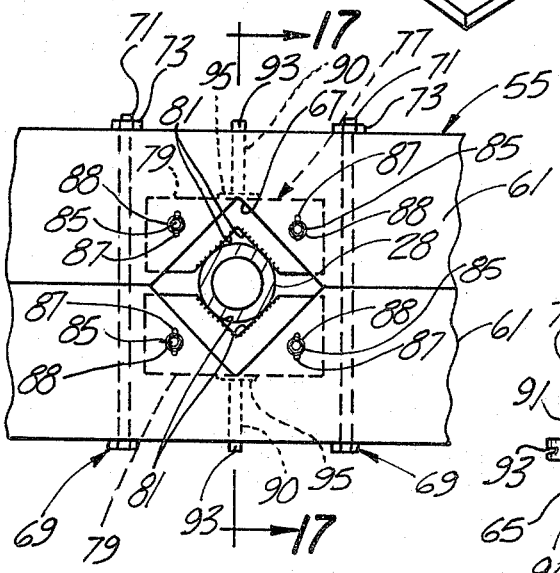
FIG. 16 is a top plan view of a portion of the tool holder shown in FIG. 14 with the column on which the tool holder is mounted shown in section.

The tool holder 55 is clamped onto the support column 28 by an adjustable clamping arrangement indicated generally by 77. This clamping arrangement includes a pair of clamp members 79 that have elongated tubular configurations of rectangular cross sections. The clamp members have V-shaped notches 81 formed in them to define clamping surfaces that engage the support column 28. Preferably, the notches have serrations 83 as best seen in FIG. 15 so as to securely grip the column. Each clamp member 79 is associated with one of the structural members 59 and is located between the upper and lower walls 61 and 63 thereof so as to be slidably supported for adjustable movement toward and away from each other. This movement allows the clamp members to clamp column 28 despite manufacturing variations in the size of the diameter thereof at different vertical positions or despite the difference in sizes among different columns, so as to maintain the structural members 59 in a unitary manner with no separation therebetween, thereby keeping a continuous worksurface regardless of the size of the column and allowing for the manufacture of a single size of drawer.

A pair of bolts 85 and washers 88 are associated with each clamp member 79 along with slots 87, and provide pin and slot arrangements that guide the clamp members during their adjusting movement. While the slots 87 are shown in the upper walls 61 of the structural members with the bolts extending downwardly into threaded apertures 89, FIG. 2, in the clamp members, these slots may alternately be provided in the lower walls 63 with the bolts extending upwardly. It is thus evident that this mounting of the clamp members between the upper and lower walls of the structural members provides an economical manner of supporting the clamp members for adjusting movement. Likewise, the pin and slot arrangements provided by bolts 85 and slots 87 guide the clamp members without any elaborate or expensive sliding guideways that would otherwise have to be welded or suitably secured to the structural members 59 in another manner. These structural members may thus be made from rolled stock in a very inexpensive manner.

Figure 17:
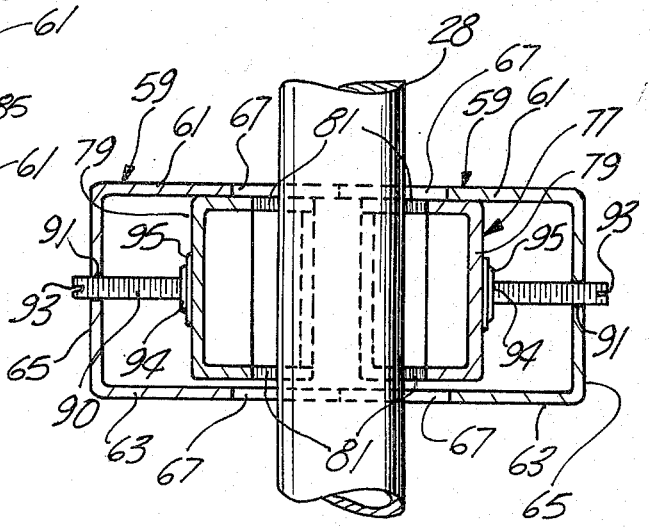
FIG. 17 is a sectional view through the tool holder taken generally along line 17—17 of FIG. 16.

The clamp members 79 are held in clamping positions engaging the column 28 by screws 90 best seen in FIG. 17. Threaded apertures 91 in the vertical walls of the structural members 59 receive the screw 90 associated with each clamp member. The outer ends of the screws 90 may include the slots 93 shown to receive a suitable screwdriver or may have bolt heads so as to be turned by a wrench. The inner ends of the screws define partial ball configurations 94 that are received within respective holes in disc shaped members 95 which engage the respective clamp members 79. Rotation of the screws 90 in one direction moves the clamp members 79 toward each other to clamp smaller size columns 28 and rotation in the opposite direction allows the clamp members to move away from each other to clamp larger ones. When the clamp members are being moved and when they are clamped on the column, the pin and slot arrangements of bolts 85 and slots 87 maintan the clamp members parallel so as to oppose each other in a 180° relationship despite the fact that the clamping force is applied to each clamp member only at a single location by the disc shaped members 95.

More than two structural members may be used; however, two is the preferred number to minimize the expense of bolts or other fasteners used to secure the structural members into the unitary tool holder. Likewise, in the broadest scope of the invention, more than two clamp members could be used to clamp the tool holder onto a vertical support column, and less than all of them could be movable, with the others fixed to still provide the adjustable mounting on columns of different sizes. However, with only two clamp members, the cost of construction is minimized, and having all of the clamp members movable allows the tool holder to be centered about the central vertical axis of the support column on which it is mounted. Also, when two or four clamp members are utilized, the tool holder may be readily clamped onto square I-beam type support columns as well as the round one shown.

I also wish it understood that, although in all of the illustrations of my invention I have shown the structural members 25 or 59 as being made out of some sort of metal, for applications where it would be practical, my invention is fully capable of being carried out with the use of wood, plastic, or other suitable structural members.

There is thus provided an improved column mounted tool holder whereby the objects of the present invention listed above, and numerous additional advantages are attained.

I claim:

1. A column mounted tool holder comprising a plurality of complementary structural members each having an upper planar surface and at least one vertical edge having a recessed portion therein, said members adapted to be arranged about a vertical support column with said vertical edges abutting each other and said recessed portions surrounding said column but being spaced therefrom so as to form a continuous upper planar surface about said support column, means for securing the structural members to each other in edge abutting relation about said column so as to be integrated into a unitary tool holder, a plurality of separate clamp members all of which are mounted on the structural members adjacent said recessed portions so as to be arranged in a horizontally spaced relationship about said support column on which the tool holder is to be mounted, each clamp member having a clamping surface opening toward the column and movable in a direction perpendicular to a plane containing the abutting edges of said structural members, and the clamp members collectively being adapted to engage the support column in clamping engagement therewith so as to support the tool holder on said support column, and means for adjustably positioning at least one of the clamp members so as to permit the tool holder to be clamped on to support columns of varying sizes.

2. The device defined in claim 1, wherein said clamping surface of each of said clamp members is of a V-shaped configuration.

3. A column mounted tool holder comprising two complimentary structural members adapted to be arranged about a vertical support column so as to be continuous thereabout, means for securing the structural members to each other about the column so as to be integrated into a unitary tool holder, two clamp members mounted on the structural members so as to be arranged in horizontally spaced relationship about the vertical column on which the tool holder is to be mounted, each clamp member having a clamping surface opening toward the column, and the clamp members collectively being adapted to engage the column in clamping engagement therewith so as to support the tool holder on the column, and means for adjustably positioning each one of the clamp members on a respective structural member with the clamping surface thereof opposing the clamping surface of the other clamp member in a 180 degree relationship, wherein the two structural members each have a generally U-shaped cross section oriented in a sideways opening direction so as to define upper and lower spaced walls and a vertical wall extending therebetween, wherein the means for securing the structural members to each other includes a pair of fastening arrangements extending between the vertical walls of the structural members so as to engage the open ends thereof and thereby providing the tool holder with a generally rectangular cross section, and wherein the clamp members are slideably positioned between the upper and lower walls of their respective structural members for movement toward and away from each other to provide the adjustable clamping of the columns of varying sizes.

4. The tool holder of claim 3, wherein a generally rectangular drawer is slidably received within the rectangular cross section of the structural members so as to hold small parts for storage.

5. The tool holder of claim 3, wherein a pair of pin and slot arrangements are provided on each clamp member and one of the spaced walls of the associated structural member so as to guide each clamp member during adjusting movement.

6. The tool holder of claim 5, wherein a pair of screws are respectively associated with the clamp members and with each screw extending between its associated clamp member and a threaded aperture in the vertical wall of the structural member on which the associated clamp member is slidably supported so that appropriate rotation of the screws moves the clamp members toward each other to clamp smaller columns and opposite rotation thereof allows the clamp members to be moved away from each other to clamp larger columns.

7. The tool holder of claim 6, in which the clamp members have elongated tubular configurations with V-shaped notches in the clamp members defining the clamp surfaces.

8. The tool holder of claim 6, wherein the ends of the screws adjacent the clamp members define partial ball shaped configurations and a pair of generally disc shaped members respectively receive these ball shaped configurations and engage the clamp members associated with the respective screws to move the clamp members toward each other to provide the clamping thereof to a support column.

9. The tool holder of claim 7, wherein the V-shaped clamping surfaces are provided with serrations that are adapted to grip a support column in a secure manner.

* * * * *